United States Patent [19]

Zimmern

[11] Patent Number: 4,492,542

[45] Date of Patent: Jan. 8, 1985

[54] GLOBAL WORM MACHINE WITH SEIZURE-PREVENTING CELLS

[76] Inventor: Bernard Zimmern, 27 rue Delabordére, 92200 Neuilly-sur-Seine, France

[21] Appl. No.: 448,073

[22] Filed: Dec. 9, 1982

Related U.S. Application Data

[63] Continuation-in-part of Ser. No. 381,566, May 24, 1982, Pat. No. 4,470,777.

[51] Int. Cl.[3] ..... F04C 18/12; F04C 29/00

[52] U.S. Cl. ..... 418/46; 418/195; 418/196

[58] Field of Search ..... 418/46, 75, 77, 79–81, 418/141, 189, 190, 195, 196, 197

[56] References Cited

U.S. PATENT DOCUMENTS

| | | | |
|---|---|---|---|
| 3,393,666 | 7/1963 | Yamamoto | 418/46 |
| 3,752,606 | 8/1973 | Zimmern | 418/195 |
| 3,999,906 | 12/1976 | Goloff | 418/142 |
| 4,295,802 | 10/1981 | Peschke | 418/46 |

FOREIGN PATENT DOCUMENTS

| | | |
|---|---|---|
| 370214 | 4/1932 | United Kingdom . |
| 593620 | 10/1947 | United Kingdom . |
| 729420 | 5/1955 | United Kingdom . |
| 970993 | 3/1961 | United Kingdom . |
| 1368366 | 9/1974 | United Kingdom . |
| 1495078 | 12/1977 | United Kingdom . |
| 1536317 | 12/1978 | United Kingdom . |

*Primary Examiner*—Leonard E. Smith
*Assistant Examiner*—Jane E. Obee
*Attorney, Agent, or Firm*—Ziems, Walter & Shannon

[57] ABSTRACT

A screw is adapted to cooperate with a casing and at least one pinion-wheel for compressing or expanding a fluid within the space located between two screw threads, the casing and a tooth of the pinion-wheel. The casing and crests of the threads carry two cooperating surfaces, and at least part of one of the surfaces comprises lands defining continuity of the surface but being discontinued along any circle centered on the axis of the screw. The lands separate cells which trap formative seizure particles and, thus, reduce the clearance needed between the screw and the casing.

3 Claims, 15 Drawing Figures

GLOBAL WORM MACHINE WITH SEIZURE-PREVENTING CELLS

This application is a continuation-in-part of application Ser. No. 381,566, filed May 24, 1982, Now U.S. Pat. No. 4,470,777.

This invention relates to a volumetric machine with screw and pinion-wheels for compressing, pumping or expanding a fluid.

The machines which are primarily contemplated in this specification comprise a screw adapted to cooperate with a casing in substantially fluid-tight manner by means of at least part of the screw-thread crests, at least one pinion-wheel which is disposed in a passageway within the casing and the teeth of which are adapted to engage with the screw threads, at least one low-pressure port located at one end of the screw and at least one high-pressure port located at the other end of the screw and separated from the pinion-wheel passageway by a casing portion of predetermined width.

Machines of this type are described in particular in U.S. Pat. Nos. 3,133,695, 3,180,565 and 3,551,082.

In order to achieve enhanced efficiency and to reduce leakages in these machines, it is a known practice to inject into the machine a liquid (usually oil) which has a cooling function (when the machine works as a compressor) and which also serves to ensure fluid-tightness by forming a true liquid seal. This has been described in particular in U.S. Pat. No. 3,133,695 cited above.

This sealing function is no longer possible when injection of liquid is suppressed. In the field of application of refrigerating compressors, for example, it is only necessary to inject the condensate of the liquefied gas into the compression chamber in order to cause vaporization of the condensate within the chamber and cooling of the different parts as well as the gas. As a consequence, there is no longer any available liquid for sealing-off the clearances between the crests of the threads and the casing. However, the size of these clearances has a decisive influence on the efficiency of the machine.

By way of example, it has accordingly been found in the case of a compressor operating with Refrigerant 22 and having a swept volume of approximately 2500 liters at 3000 rpm that the thermodynamic efficiency of the compressor decreases by approximately 1% each time the clearance between screw and casing increases by 10 microns.

Attempts have been made to reduce this clearance but all tests on radial clearances of less than approximately 70 to 100 microns invariably result in seizure of the screw within the casing to an extent which is usually permanent, with the result that the two parts cannot be separated without destruction.

The object of the present invention is to provide a volumetric machine in which the clearances are of sufficiently small value to maintain high efficiency while at the same time removing any potential danger of seizure.

In accordance with the invention, the machine corresponds to the specification cited in the foregoing and is distinguished by the fact that one of the two cooperating surfaces respectively of the casing and of the screw is provided with a number of cells at least on part of the area of cooperation of said surface with the other surface, and by the fact that the periphery of each cell carried by a thread crest or carried by the casing in a position to cooperate with the thread crests is at the most cut by only one of the two edges of a thread crest carrying or facing said cell. The part of the area of cooperation comprises lands defining continuity of the surface but being discontinued along any circle centered on the axis of the screw.

It has been found that cells of the aforementioned type make it possible to remarkably reduce the screw-casing clearance without inducing any seizure.

One explanation which can be given by way of indication without thereby implying any limitation of the scope of the invention is that seizure can be caused by impurities which have remained within the machine. Such impurities result in micro-seizure which is localized but has a tendency to spread to areas in which the thread crests are of substantial width and particularly to the high-pressure end since the seizure particle or chip undergoes a displacement in rolling motion without finding any escape route.

The presence of the cells serves to check spontaneous increase in size of the seizure chip which is thus being formed since it falls into one of the cells, is thus prevented from rolling further and is subsequently removed.

In a preferred embodiment, the cells are recesses separated from each other by lands, and any plane which is perpendicular to the axis of the screw and meets the celled surface alternately cuts recesses and lands along its intersection line with said surface.

By reason of the fact that the lands of the cells are not continuously disposed on circles centered on the axis of rotation, any chip formed between these lands and the casing rapidly falls into a cell by rolling and is then stopped.

In this manner, the screw-casing clearance could be reduce to values of the order of 20 to 30 microns.

The depth of the cells is advantageously less than 0.2 mm in order to minimize any possible leakage-flow bridge effects. In principle, the cells can be machined either on the casing or on the screw.

Should the cells be formed on the screw, the dimension of the cells in the direction of their displacement is preferably smaller than the width of the casing zone located between the high-pressure port and the pinion-wheel passageway in order to guard against the formation of a leakage-flow bridge between said high-pressure port and the pinion-wheel passageway which is exposed to low pressure.

Other distinctive features and advantages of the invention will be more apparent upon consideration of the following description and accompanying drawings, wherein.

Figure 3:
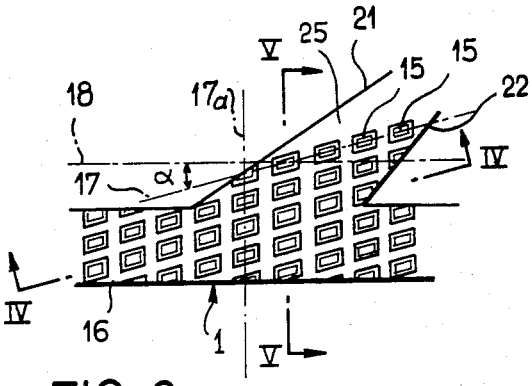
FIG. 3 is a view to a larger scale showing part of FIG. 1.

FIGS. 8, 10, 12 and 14 are views similar to FIG. 3 but showing alternative embodiments; and FIGS. 9, 11, 13 and 15 are views to a larger scale of the cells of FIGS. 8, 10, 12 and 14 respectively.

Figure 1:
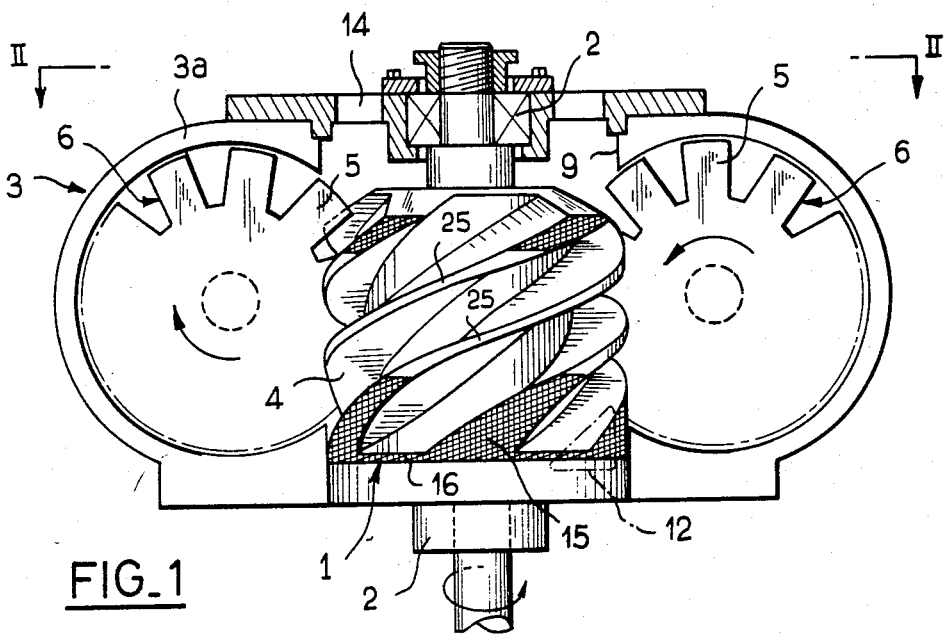
FIG. 1 is a longitudinal view of a compressor in accordance with the invention in which one half-casing has been removed, this view being taken along line I—I of FIG. 2.
Figure 2:
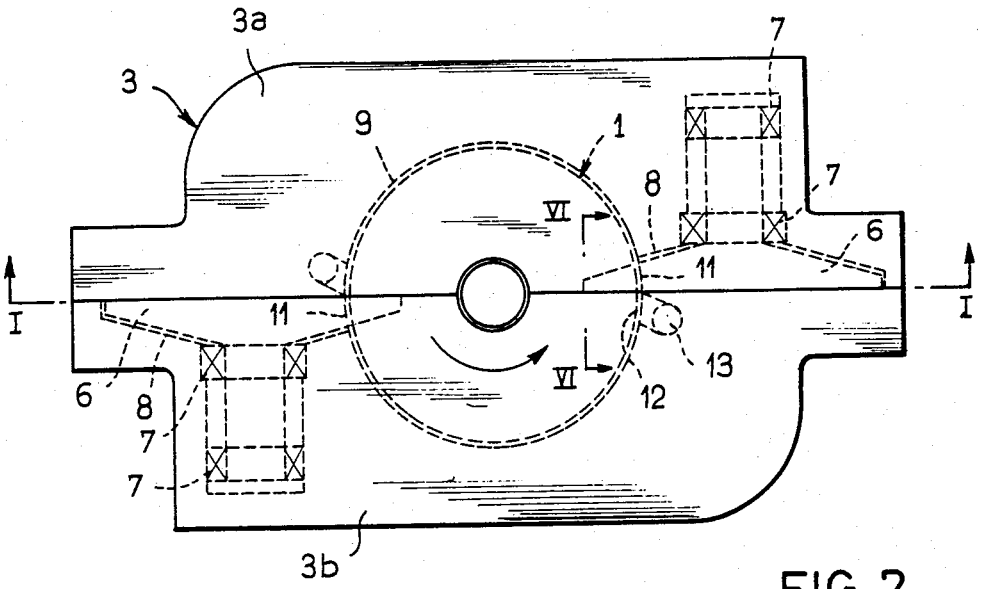
FIG. 2 is a plan view taken along line II—II of FIG. 1.

Referring to FIGS. 1 and 2, the compressor in accordance with the invention comprises a screw 1 rotatably mounted in bearings 2 within a casing 3 which is made up of two parts 3a, 3b. Said screw is adapted to cooperate with said casing in relatively fluid-tight manner by means of the crests 25 of the screw threads 4.

A motor (not shown in the drawings) is coupled with the screw 1 in order to cause this latter to rotate in the direction of the arrow.

The threads 4 of the screw 1 are disposed in meshing engagement with the teeth 5 of pinion-wheels 6 which are freely rotatable in bearings 7 fixed respectively on the half-casings 3a and 3b.

The pinion-wheels 6 are located within cavities 8 of the casing and project into a cylinder 9 to a partial extent through passageways 11, said cylinder being used as a housing for the screw 1.

Figure 6:
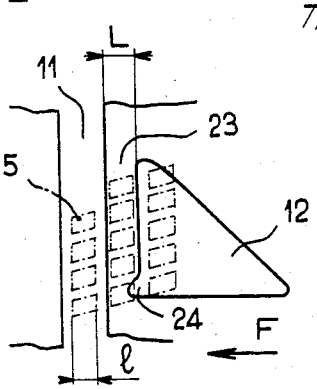
FIG. 6 is a view taken along line VI—VI of FIG. 2.

As shown in FIG. 6, a triangular port 12, one side of which is substantially parallel to the slope of the threads 4, is provided in the cylinder 9 are adapted to communicate with a discharge port 13. As can be appreciated from FIGS. 1 and 2, the casing 3 includes two halves, 3a and 3b, which define the cylinder 9 in which the screw 1 rotates and the cavities 8 in which the pinion-wheels 6 rotate. The cylinder 9 has a generally continuous cylindrical wall except for the triangular ports 12 and for the area of intersection of the cylinder 9 with the cavities 8. In the areas of intersection, the passageways 11 exist which allow the teeth 5 of the pinion to extend in between the threads 4 of the screw. One passageway 11 is shown in FIG. 6 as being separated from the triangular port 12 by a relatively thin zone 23 of the casing. The triangular port 12, which is shown in phantom in FIG. 1, is present in the half 3b of the casing 3 which fits over the portion of the casing illustrated in FIG. 1. This can be seen from FIG. 2, in which the triangular port 12 is in advance of the passageway 11 when considering the FIG. 6, in which the triangular port 12 lies to the right of the passageway 11.

During operation, the screw 1 transmits motion to the pinion-wheels 6 which rotate in the direction of the arrows; each tooth 5 which comes into mesh with the screw traps a predetermined quantity of gas which is admitted through the intake 14 into the space formed between the casing, the two threads of the screw with which said tooth is in mesh, and the face of said tooth.

The volume of the space aforementioned decreases progressively, thus compressing the gas which is trapped within said space. Discharge takes place when the space comes into position opposite to the port 12.

Cells 15 are provided on the outer surface of the screw (as shown in FIG. 3) and essentially in that part of said screw in which the thread crests have the greatest width or in other words over a distance corresponding practically to the lower third and upper third of the length of the screw.

Said cells are formed not only on the crests 25 of the threads, but also on the circular strip 16 which is located between the end of the threads (on the high-pressure side) and the end of the screw.

The strip 16 is attached to the screw threads and rotates with them. In FIGS. 1 and 3, the strip 16 is shown as being unitary with the screw threads. The space formed by the casing 3, the threads 4 of the screw and the face of the pinion-tooth 5 is the space in which the gas is compressed and from which the gas is discharged through the triangular port 12. The strip 16 provides a bottom surface for the space.

In the example of FIGS. 1–7, the cells 15 are quadrilaterals aligned in rows, the axis 17 of which is inclined at a predetermined angle $\alpha$ (as shown in FIG. 3) with respect to planes 18 perpendicular to the axis of rotation of the screw. The precise value of this angle is unimportant but, in this example must essentially be larger than zero in order to ensure that lands 19 which form separations between the cells are inclined at an angle with respect to said circle. The angle $\alpha$ can attain 45° without any inconvenience. As shown in FIG. 3, the cells 15 also form a second group of rows 17a intersecting with the rows 17 of the first group and also forming an angle with the planes 18 perpendicular to the axis of the screw. The lands 19 defining the rows 17 and 17a are parallel to the rows 17 and 17a and, thus, comprise two groups of rows both of which also form angles with the planes 18 perpendicular to the axis of the screw.

The lands 19 are also arranged in intersecting parallel rows, one group of the illustrated rows being axial with respect to the screw 1 and the other group of rows forming a small angle with a plane perpendicular to the axis of the screw 1.

Thus, any plane 18 (FIG. 3) perpendicular to the axis of the screw and meeting the surface provided with cells, alternately cuts lands and cells along its line of intersection with the surface provided with such cells.

It is also essential to ensure that each cell is completely inscribed within the thread crest on which it is formed or that said cell is cut by only one of the two edges 21, 22 of said crest in order to prevent formation of any leakage-flow bridge between the two sides of the thread. In the example herein described, which relates to a screw 140 mm in diameter, this condition is satisfied by adopting a pitch p of 2 mm. Since the crests of the screw threads 4 fit closely within the casing 3 in which the screw 1 rotates, they prevent the gas being compressed in a particular groove from escaping from its groove into adjacent grooves. It can be seen especially from FIG. 3 that, if one of the cells 15 extended all the way across the crest of the screw thread 4 from the edge 21 to the edge 22, it would allow the gas being compressed in one groove to flow through the cell across the crest of the screw thread to the adjacent groove.

Figure 4:
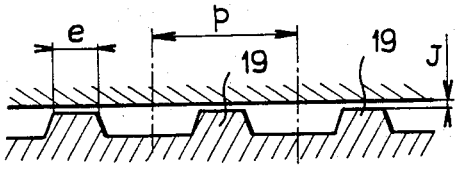
FIGS. 4 and 5 are sectional views respectively along lines IV—IV and V—V of FIG. 3.
Figure 5:
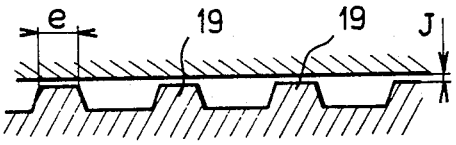

In this example, the clearance J (as shown in FIGS. 4 and 5) between the screw and the casing is very small, namely of the order of a few tens of microns. The depth of the cells is of the order of 0.1 to 0.15 mm and the thickness e of the lands 19 is of the order of 0.5 mm.

The view of FIG. 6 shows the cylindrical wall 9 of the casing which cooperates with the screw, in the region corresponding to the discharge port 12 and the pinion-wheel passageway 11. The screw cells 15 which pass in front of this portion of the casing are shown in chain-dotted lines. The operating principle of the compressor is such that the width L of the zone 23 between said two ports must have a minimum value, thereby ensuring that no volume of gas is liable to be trapped within the screw thread and prevented from escaping. Furthermore, in order to prevent formation of a leakage-flow bridge between the port 12 which is at high pressure and the passageway 11 which is at low pressure, it is necessary to ensure that the dimension 1 of the cells in the direction F of their displacement is smaller than the width L.

In order to avoid the need to machine very small cells since this would be a costly operation, a relatively substantial width L has been maintained over the greater part of the zone 23 whereas the port 12 has been enlarged by means of groove 24 which extends over part of said zone. The groove 24 permits the discharge of compressed gas remaining in the groove near its bottom which would otherwise be lost, since the crest of the thread 4 following the thread groove would cross the casing zone 23 before the gas was able to discharge to the triangular port 12. Any leakage which may subsequently develop is thus highly localized. Furthermore, such leakage is reduced to a very low value by the small depth of the cells, which also has the effect of reducing to a negligible value the volume of high-pressure gas which is transferred by the cell as it undergoes rotational displacement from the high-pressure port to the pinion-wheel passageway.

The cell which has been described and illustrated in the accompanying drawings has the shape of a quadrilateral but, as will be seen hereinafter, other shapes such as circles or polygons, for example, can produce equivalent results. A quadrilateral is particularly easy to produce when the cells are formed by the electrical discharge machining process (EDM) since it is possible in this process to form the EDM electrode simply by means of two cross-directional milling operations.

However, profiles of greater complexity can be formed by means of other methods such as knurling or electrochemical deposition of a filler metal for building-up the lands, in which case the cells are obtained by preliminary deposition of a mask made of varnish, for example, which is subsequently removed.

The use of the cells has made it possible to provide very small clearance of the order of a few tens of microns without giving rise to seizure, even when the screw and the casing are formed of the same metal such as cast-iron, for example.

Now this advantage is an essential condition for the successful construction of air-conditioning and refrigeration compressors of the single-screw type without oil injection (with all the attendant advantages of lower cost and non-pollution of circuits due to suppression of oil) while achieving thermodynamic efficiencies which place this machine in the highest rank from an efficiency standpoint. Thus in the case of a compressor equipped with a screw 140 mm in diameter which is rotatably mounted in a casing with a radial clearance of 30 microns at 3000 rpm, measurements taken with Refrigerant 22 and with compression ratios of the order of 3 have shown isentropic efficiencies of the order of 77% which are an average 10 to 20% higher than the best comparable machines of known type and of similar swept volume.

With clearances of the order of 0.1 mm which have been adopted up to the present time, efficiencies do not exceed 70%.

Referring now to FIGS. 8–15, different embodiments of cells have been shown, which all meet the condition that any plane 18 perpendicular to the axis of the screw alternately meets calls and lands along its line of intersection with the surface provided with cells. This is ascertained by FIGS. 9, 11, 13 and 15 showing planes 18 in all the main possible positions in each case.

Figure 8:
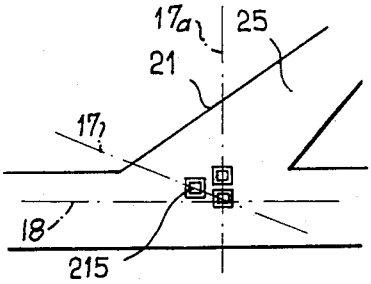
Figure 9:
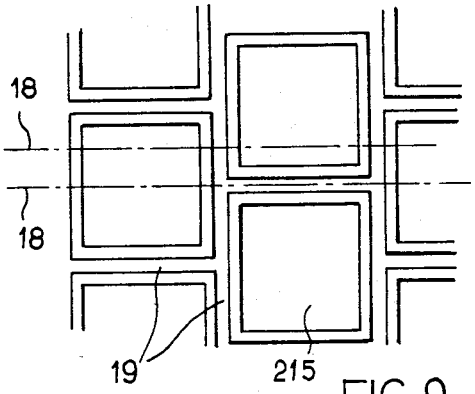
Figure 10:
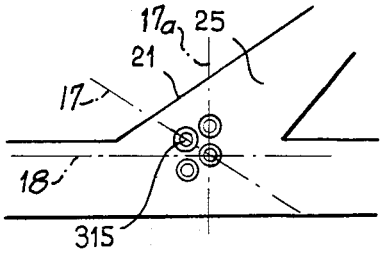
Figure 11:
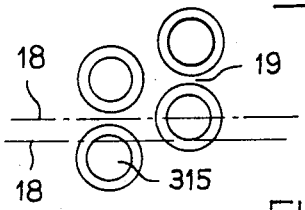

In FIGS. 8 and 9, the cells are square-shaped and in FIGS. 10 and 11 they are circular. In both cases they are disposed in axial rows 17*a* each of which is shifted by the axial length of a half-cell with respect to both neighboured rows, so that the cells are also disposed along rows 17 forming a certain acute angle with respect to planes 18.

Figure 12:
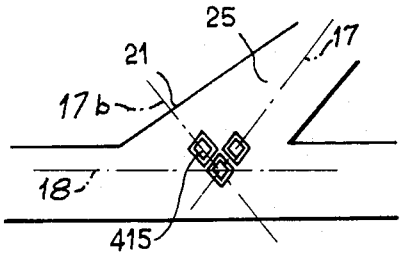
Figure 13:
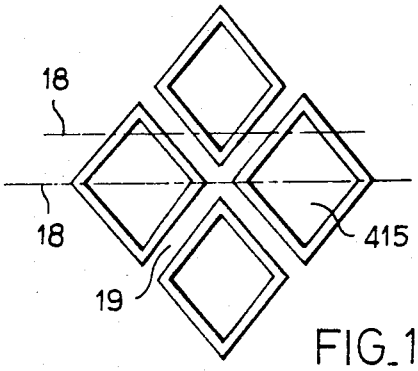

In FIGS. 12 and 13, the cells are diamond shaped and separated by lands having two directions both inclined with respect to planes 18 so that the cells are disposed along two groups of rows 17 and 17*b* intersecting with each other and both inclined with respect to planes 18.

Figure 14:
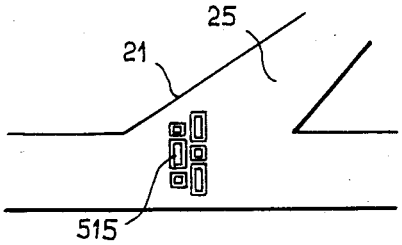
Figure 15:
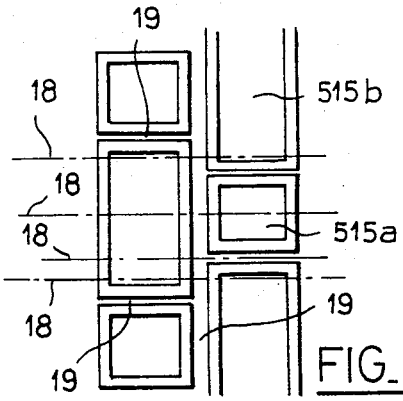

In FIGS. 14 and 15, the cells are rectangular and are of two types having different lengths as measured parallel to the axis of the screw. The centers of cells are aligned in aixal direction and in circumferential direction. In both directions, there is alternately one large cell and one small cell.

In accordance with an alternative embodiment of the invention, the cells are formed in the casing wall which cooperates with the crest of the screw threads. Such an arrangement is particularly advantageous when the shape of the casing is suited to this form of construction as in the case, for example, with a flat or conical casing which readily permits the approach of an EDM electrode.

Figure 7:
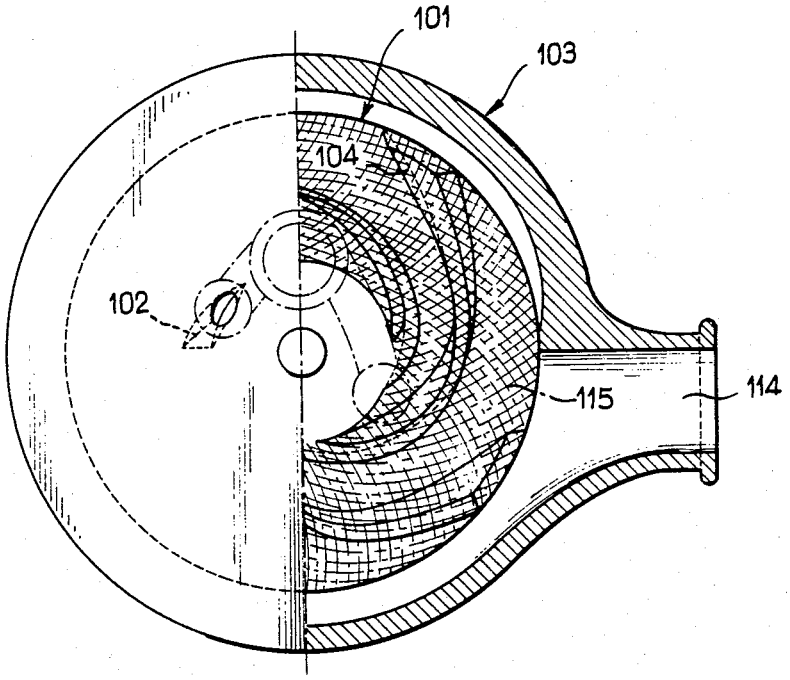
FIG. 7 is a part-sectional plan view of another type of compressor in accordance with the invention.

With reference to FIG. 7, a plane screw 101 is rotatably mounted within a casing 103 provided with a low-pressure intake 114. The use of the term "plane screw" is explained by the fact that the crests of the threads 104 are located in the same plane and cooperate with a flat portion of the casing. A pinion-wheel (not shown in the drawings) is located in a plane at right angles to the plane of the screw and the pinion teeth mesh with the thread groove which is shaped accordingly. A compressor of this type is described in greater detail in U.S. Pat. No. 3,180,565.

The clearance between the crests of the threads and the casing is of the same order as in the previous embodiment and the cooperating surface of the casing is provided with cells 115 (not shown in the drawings), only the axes of alignment of said cells being shown in the figure and represented by chain-dotted lines. Said axes are slightly curved and satisfy the condition of never being parallel to a circle centered on the axis of rotation of the screw. The cells are thus of the kind of FIGS. 1–7, 8–9, 10–11 or 12–13, but the kind of FIGS. 14–15 or other kinds could as well have been chosen.

In this embodiment, it is important to ensure that the depth of the cells is reduced to a minimum and to ensure if possible that said depth does not exceed values of the order of 0.10 to 0.15 mm in the case of machines having a swept volume of the order of one liter per revolution.

It should in fact be borne in mind that, during the displacement of the screw threads, each cell is filled with gas under pressure and the gas then expands as the following thread arrives. The work output thus produced to no useful purpose is liable to attain considerable values in a very short time, thus removing all the benefit gained by the cells.

While the arrangement in accordance with the invention is advantageous in the case of machines without sealing liquid, said arrangement is also of considerable interest when the sealing liquid (in a compressor or expansion machine) has very low viscosity, for example when oil is replaced by water which constitutes a seal of lower resistance, or in the event of utilization of the machine as a pump or hydraulic motor when the liquid employed also has low viscosity. As will be readily apparent, the invention is not limited to the examples hereinbefore described but extends to any alternative form or any application within the capacity of those versed in the art.

What is claimed is:

1. A volumetric machine for compressing, pumping or expanding a fluid, comprising a casing, a screw having screw threads defining crests and grooves, said screw being rotatable in said casing on an axis of rotation, said casing and the crests of said screw threads carrying two cooperating surfaces for establishing between said screw and said casing a substantially fluid-tight relationship as a result of the mutual proximity of said cooperating surfaces, at least one pinion-wheel which is disposed in a passageway within the casing and the teeth of which are adapted to engage with the screw grooves, at least one low-pressure port located at one end of the screw and at least one high-pressure port located at the other end of the screw and separated from the pinion-wheel passageway by a casing zone of predetermined width, wherein at least part of one of the two cooperating surfaces respectively of the casing and of the screw comprises lands defining continuity of said one surface, but being discontinued along any circle centered on the axis of the screw and wherein said lands separate cells from each other, the periphery of each cell being capable of intersection simultaneously by at most only one of the two edges of any of said thread crests, the cells being arranged in rows separated from each other by lands forming an angle with a plane perpendicular to the axis of the screw, and some at least one the lands being arranged in at least two groups of parallel rows, the rows of one group intersecting with the rows of the other group, the rows of both groups forming an angle with a plane perpendicular to the axis of the screw.

2. A volumetric machine for compressing, pumping or expanding a fluid, comprising a casing, a screw having screw threads defining crests and grooves, said screw being rotatable in said casing on an axis of rotation, said casing and the crests of said screw threads carrying two cooperating surfaces for establishing between said screw and said casing a substantially fluid-tight relationship as a result of the mutual proximity of said cooperating surfaces, at least one pinion-wheel which is disposed in a passageway within the casing and the teeth of which are adapted to engage with the screw grooves, at least one low-pressure port located at one end of the screw and at least one high-pressure port located at the other end of the screw and separated from the pinion-wheel passageway by a casing zone of predetermined width, wherein at least part of one of the two cooperating surfaces respectively of the casing and of the screw comprises lands defining continuity of said one surface, but being discontinued along any circle centered on the axis of the screw and wherein said lands separate cells from each other, the periphery of each cell being capable of intersection simultaneously by at most only one of the two edges of any of said thread crests, the cells being arranged in substantially axial rows, each row being shifted longitudinally with respect to both neighbored rows.

3. A volumetric machine for compressing, pumping or expanding a fluid, comprising a casing, a screw having screw threads defining crests and grooves, said screw being rotatable in said casing on an axis of rotation, said casing and the crests of said screw threads carrying two cooperating surfaces for establishing between said screw and said casing a substantially fluid-tight relationship as a result of the mutual proximity of said cooperating surfaces, at least one pinion-wheel which is disposed in a passageway within the casing and the teeth of which are adapted to engage with the screw grooves, at least one low-pressure port located at one end of the screw and at least one high-pressure port located at the other end of the screw and separated from the pinion-wheel passageway by a casing zone of predetermined width, wherein at least part of one of the two cooperating surfaces respectively of the casing and of the screw comprises lands defining continuity of said one surface, but being discontinued along any circle centered on the axis of the screw and wherein said lands separate cells from each other, the periphery of each cell being capable of intersection simultaneously by at most only one of the two edges of any of said thread crests, the cells being of two types having different axial length and their centers being aligned in axial rows and in circumferential rows, the cells being alternately of the large and of the small type along the axial and the circumferential rows.

* * * * *

UNITED STATES PATENT AND TRADEMARK OFFICE

CERTIFICATE OF CORRECTION

PATENT NO. : 4,492,542

DATED : January 8, 1985

INVENTOR(S) : Bernard Zimmern

It is certified that error appears in the above—identified patent and that said Letters Patent is hereby corrected as shown below:

Column 5, line 60, "calls" should be "cells";
Column 6, line 11, "aixal" should be "axial";
Column 7, Claim 1, line 28, "one" should be "of".

Signed and Sealed this

*Sixteenth* Day of *July 1985*

[SEAL]

*Attest:*

DONALD J. QUIGG

*Attesting Officer* *Acting Commissioner of Patents and Trademarks*